United States Patent [19]

Kim

[11] Patent Number: 5,035,329

[45] Date of Patent: Jul. 30, 1991

[54] TEAR STRIP OPENING DEVICE

[76] Inventor: Myun H. Kim, 42-16 80th St., Apt. 6B, Elmhurst, N.Y. 11373

[21] Appl. No.: 947,806

[22] Filed: Dec. 30, 1986

[51] Int. Cl.[5] ..... B65D 3/26

[52] U.S. Cl. ..... 206/615; 206/610; 206/618; 206/632

[58] Field of Search ..... 206/605, 610, 613, 615, 206/616, 617, 618, 632

[56] References Cited

U.S. PATENT DOCUMENTS

| | | | |
|---|---|---|---|
| 1,027,994 | 5/1912 | Crawford | 206/618 |
| 2,352,766 | 7/1944 | Bogue | 206/616 X |
| 3,011,691 | 12/1961 | McGlynn et al. | 206/616 X |
| 3,195,799 | 7/1965 | Denenberg | 206/616 |
| 3,321,126 | 5/1967 | Rivman et al. | 206/616 |
| 3,565,329 | 2/1971 | Wagner. Jr. et al. | 206/618 |
| 3,653,585 | 4/1972 | Kazaros | 206/618 X |

FOREIGN PATENT DOCUMENTS

| | | | |
|---|---|---|---|
| 515480 | 4/1921 | France | 206/618 |
| 1194243 | 11/1959 | France | 206/618 |
| 117001 | 12/1926 | Switzerland | 206/618 |
| 400750 | 4/1966 | Switzerland | 206/618 |

*Primary Examiner*—Bryon P. Gehman

*Attorney, Agent, or Firm*—Schweitzer Cornman & Gross

[57] ABSTRACT

A tear strip opening device disposed on a sealing portion of a container which comprises a non-tearable plastic strip or ridge positioned on the inside thereof along a perforated punch line and a non-tearable material e.g. a small plastic band disposed outside of the sealing portion thereof and on the opposite side of the non-tearable strip. Thus, the plastic strip or ridge disposed between the non-tearable band and a glued portion disposed on the inside of the sealing portion thereof is in substantially parallel relationship to the plastic band for use in easily and readily opening the container.

7 Claims, 3 Drawing Sheets

TEAR STRIP OPENING DEVICE

BACKGROUND OF THE INVENTION

The present invention relates to a tear strip opening device. More particularly, the present invention relates to a container, for example, a package or an envelope containing a non-tearable plastic strip or ridge positioned on an inside surface of a sealing portion of the container. The plastic strip is positioned between dotted punch lines and disposed between a small plastic band attached to the outside surface of the sealing portion, on one side, and a glued portion disposed on the inside surface of the sealing portion thereof, on the other side, for use in easily and readily opening the container.

Many types of package opening devices have been developed in the packaging industry to facilitate the opening of packages. For example, packages such as sugar containers or the like have been designed with perforated punch lines disposed along the middle of the packages. Also, envelopes have been designed to contain a thread positioned along the bottom thereof. However, these packages and envelopes suffer from a number of disadvantages, such as they are difficult to open easily and, thus, an opening device, such as a paper opener, must be used for opening the packages or envelopes. Also, it has been found that the thread positioned along the bottom of an envelope produces a zigzag cut in the paper when the containers are opened. Furthermore, to tear packages provided with perforated punch lines, made of thin paper products is very difficult.

In the specification in my copending applications Ser. Nos. 901,741 and 901,744 titled "a tear strip opening device" and filed on Aug. 29, 1986, I have described and claimed a tear strip opening device characterized by utilizing a pair of plastic bands attached to the outside surface of the container. However, it is notable that, if the tear strip opening device is utilized on the sealing portion of the envelope or package, one of the pair of plastic bands should be attached to the glued portion thereof, which increases the manufacturing cost.

OBJECTS AND SUMMARY OF THE INVENTION

Accordingly, it is an object of the present invention to provide a tear strip opening device for use in producing a straight opening in a package or envelope in an easy manner.

Another object of the present invention is to provide a package which utilizes a plastic strip tightly attached to a sealing portion of an envelope for facilitating the easy opening thereof.

A further object of the present invention is to provide a package or envelope containing a non-tearable plastic strip or ridge positioned on the inside thereof along perforated punch line and a non-tearable material e.g., a plastic band disposed on the outside of the package or envelope and on opposite sides of the non-tearable plastic strip or ridge. Thus, the plastic band is disposed between the adjacent the non-tearable band and a glued portion disposed on the inside of the sealing portion thereof is a substantially parallel relationship to the plastic strip for use in easily and readily opening the envelope or package.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a tear strip opening device disposed on a sealing portion of a container which comprises a non-tearable plastic strip or ridge positioned on the inside thereof along a perforated punch line and a non-tearable material e.g. a small plastic band disposed outside of the sealing portion thereof and on the opposite side of the non-tearable strip. Thus, the plastic strip or ridge disposed between the non-tearable band and a glued portion disposed on the inside of the sealing portion thereof is in substantially parallel relationship to the plastic band for use in easily and readily opening the container.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
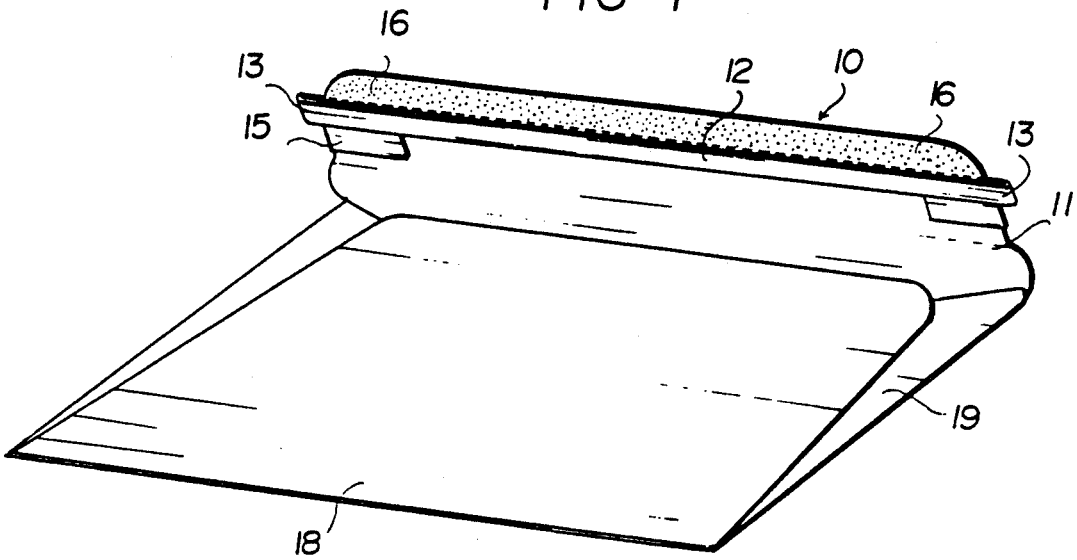
FIG. 1 is a perspective view of an unsealed envelope including the tear strip opening device disposed on a sealing portion thereof, of the present invention.
Figure 2:
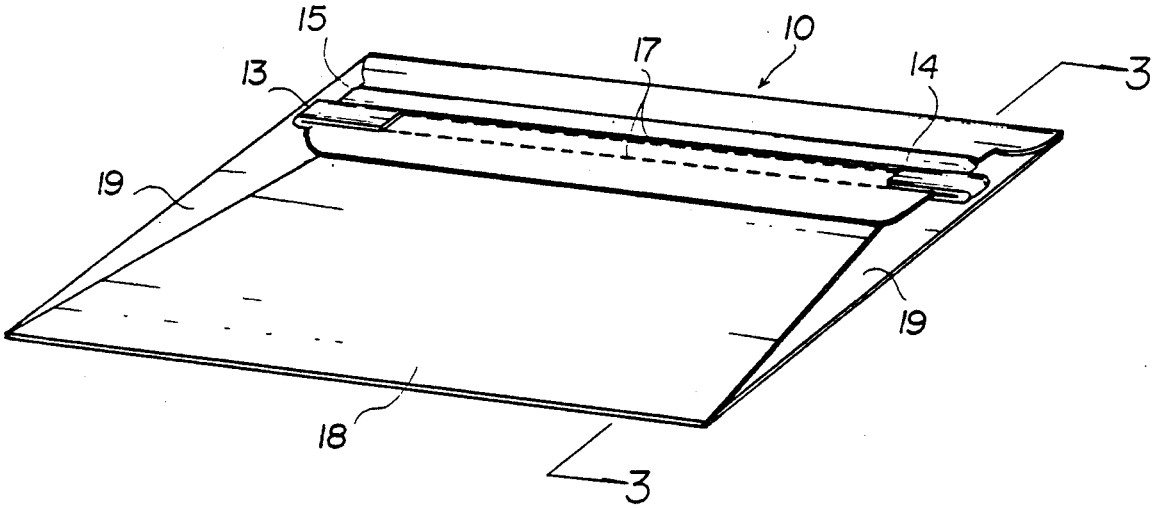
FIG. 2 is a perspective view of an envelope including the tear strip opening device disposed on the sealing portion thereof, according to the present invention.
Figure 6:
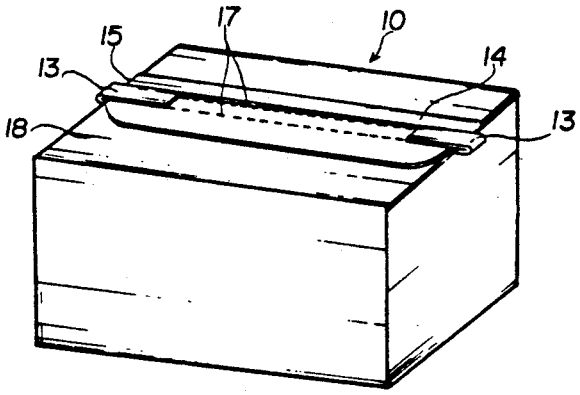
FIG. 6 is a perspective view of a sealed carton including the tear strip opening device disposed on a sealing portion thereof, of the present invention.
Figure 7:
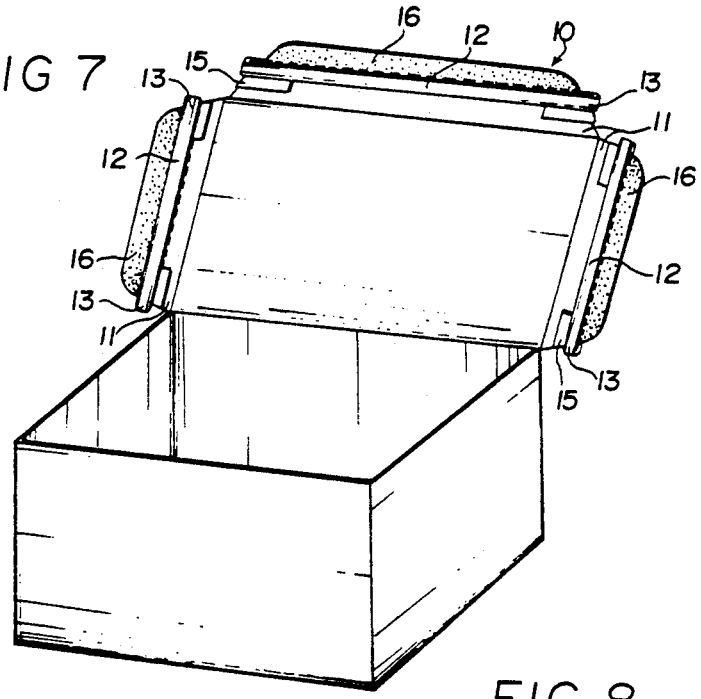
FIG. 7 is a perspective view of an unsealed carton including the tear strip opening device disposed on triple sealing portions thereof, of the present invention.
Figure 8:
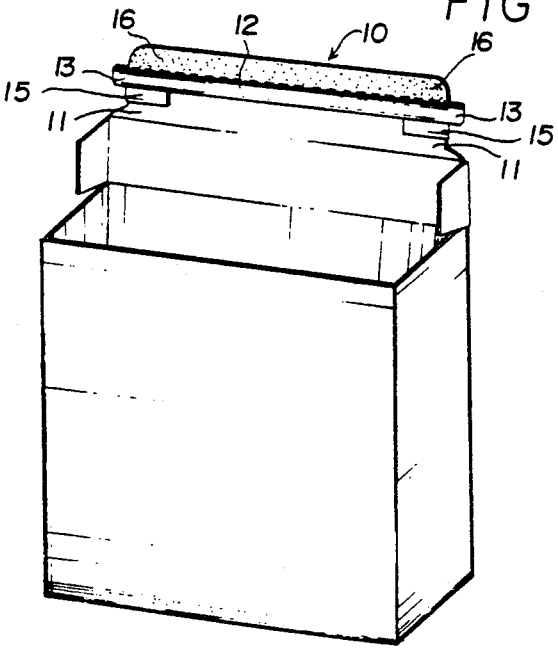
FIG. 8 is a perspective view of an unsealed carton including the tear strip opening device disposed on a sealing portion thereof, of the present invention.

Referring now in detail to the drawings for the purpose of illustrating the present invention, the tear strip opening device for opening a container 10 as shown in FIGS. 1 and 2 comprises a non-tearable plastic strip or ridge 12 sealably attached to the inside surface of a sealing portion 11 of the container 10 such as an envelope or a package (FIGS. 6, 7, and 8), disposed between perforated punch lines 17. A small plastic band 14 is sealably attached to the outside surface of the sealing portion 11 of the container 10 and disposed on the opposite side from the plastic strip 12. The sealing portion 11 of the container 10 is provided with a glued portion 16 disposed on the inside surface thereof. The glued portion 16 and the plastic band 14 are disposed substantially parallel to each other and on opposite sides from each other.

Figure 3:
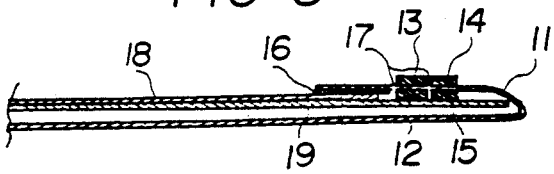
FIG. 3 is a cross-sectional view of FIG. 2, taken along line 3—3.

Both ends of the plastic strip or ridge 12 extend and fold around the surface of the sealing portion 11 of the container 10 for exposing the end of the band 12 which function as handles 13 for facilitating the opening of the container 10 (FIG. 2). Both ends of the plastic band 14 fold around the surface of the sealing portion 11 of the container 10 for forming folded ends 15 for easily tearing the plastic band 12 from the sealed container 10 (FIG. 1). The glued portion 16 is disposed on the same side as the plastic strip or ridge 12. The perforated punch lines 17 are disposed only on the sealing portion 11 of the container 10 (FIG. 3).

The non-tearable plastic strip or ridge 12 can be made of any type of material which is sufficiently strong to cut paper products. Suitable band materials include flexible plastic materials such as polyvinyl chloride or the like. Also, the non-tearable plastic band 14 sealed to the outside surface of the sealing portion 11 of the container 10 by a conventional manner is made of various synthetic plastic materials to easily and readily tear the plastic strip 12 from the sealed container 10 (FIG. 4).

Figure 5:
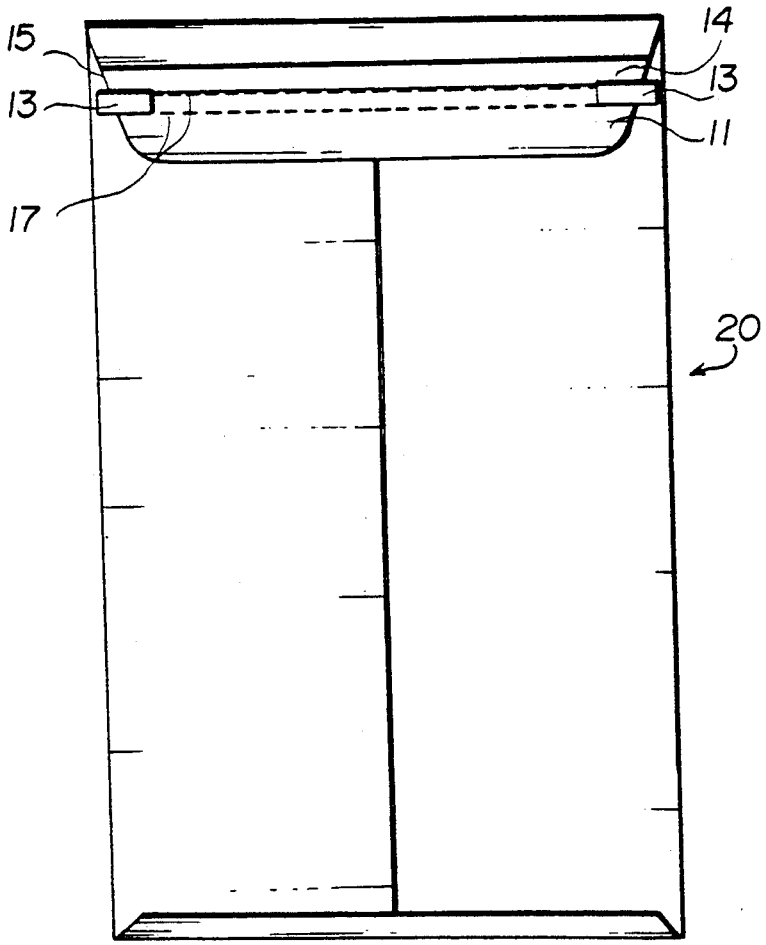
FIG. 5 is a front view of a large envelope containing the tear strip opening device thereof in another embodiment of the present invention.

FIG. 5 illustrates another embodiment of the present invention. In this regard, also, the tear strip device is located on the sealing portion 11 of the large envelope 20. The small non-tearable plastic strip 12 and band 14 are disposed on opposite sides from each other and provided with perforated punch lines 17 disposed there between for easily cutting the paper products. The handles 13 made by folding both ends of the plastic strip 12 can be readily grasped by the user.

In operation, for example, the paper to be formed into an envelope 10 is provided with the plastic strip 12 sealably attached to the inside surface of the sealing portion 11 thereof. After a letter or enclosures is inserted into the envelope 10, the envelope is sealed with the glued portion 16 of the sealing portion 11 to side portions 19 and a front portion 18 thereof (FIG. 2).

Figure 4:
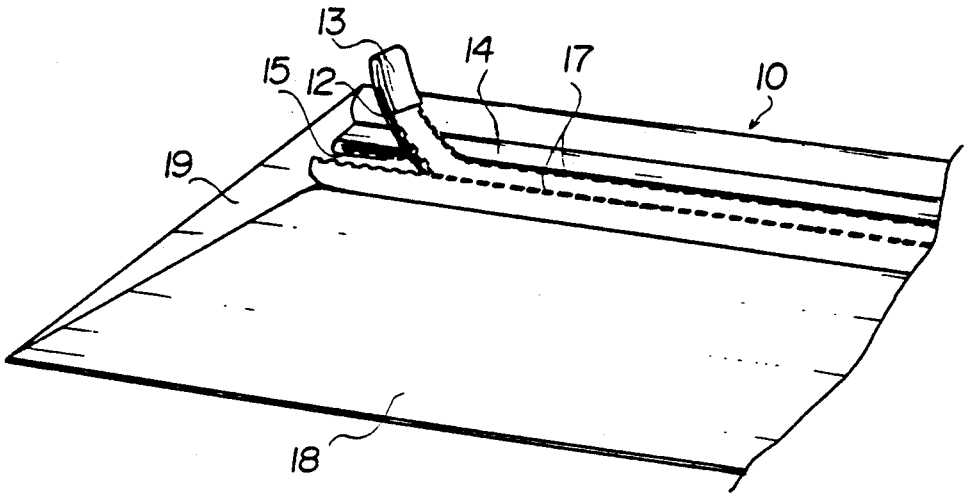
FIG. 4 is an enlarged perspective view showing an opening tab of the envelope including the tear strip opening device of the present invention.

As shown in FIG. 4, the envelope can be readily opened by tearing off the handle 13 and tearing the envelope 10 along the perforated punch lines 17 with the plastic strip 12. At this time, the non-tearable plastic strip 12 can be readily separated from the sealed envelope 10 since the non-tearable plastic strip 12 is disposed between the non-tearable plastic band 14 and the pasted and sealed glue portion 16 on the outside surface and the inside surfaces, respectively of the sealing portion 11 of the small and large envelopes 10 and 20.

Although the tear strip is shown for opening a letter, it is apparent that it could be utilized for opening any type of container which can be readily cut by the tear strip. Thus, a paper opening device, e.g., a letter opener is never necessary in the present invention. It is also apparent that the exposed handle can be eliminated as long as there is an effective way of grasping the tear strip, for example, by the use of a tab attached to one end of the tear strip.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A device for opening a sealed container, wherein the container has a sealing portion having inside and outside surfaces, which comprises;

(a) a non-tearable band sealably attached to the outside surface of said sealing portion of the container, and (b) a non-tearable strip sealably attached to the inside surface of said sealing portion of the container, said band and said strip being disposed substantially parallel to each other whereby when the strip is freed and pulled away from the sealed container, the container can be readily opened with straight tear lines which extend along the non-tearable band of said container.

2. The device of claim 1 wherein the non-tearable strip contains free ends which extend and fold from the inside to the outside of the sealing portion of the container.

3. The device of claim 1 wherein the container is an envelope.

4. The device of claim 1 wherein the band and strip are made of plastic.

5. The device of claim 4 wherein the band is made of polyvinyl chloride.

6. The device of claim 1 wherein the sealing portion of the container is provided with an adhesive portion on its inside surface, and said non-tearable strip is located between said adhesive portion and said non-tearable band.

7. The device of claim 1 wherein the container is a carton.

* * * * *